United States Patent [19]

Thompson

[11] 4,372,331

[45] Feb. 8, 1983

[54] LIPSTICK APPLICATOR DEVICE

[76] Inventor: Howard Thompson, 125 NW. 5th St., Oklahoma City, Okla. 73102

[21] Appl. No.: 268,479

[22] Filed: May 29, 1981

[51] Int. Cl.[3] ..... A45D 40/22

[52] U.S. Cl. ..... 132/88.7; 132/79 C; 132/79 G; 132/82 A; 132/83 R; 206/235; 206/385; 206/823; 401/88

[58] Field of Search ..... 132/88.7, 88.5, 82 D, 132/82 A, 82 F, 83 B, 83 F, 83 G, 79 R, 79 A, 79 C, 79 F, 79 G, 82 R, 88.7, 1 R, 83 R; 206/235, 385, 873; 401/88

[56] References Cited

U.S. PATENT DOCUMENTS

| | | | |
|---|---|---|---|
| 1,815,463 | 7/1931 | Pickey | 132/83 G |
| 2,035,356 | 3/1936 | White et al. | 132/79 G |
| 2,372,777 | 4/1945 | Gorman | 132/88.7 X |
| 2,416,029 | 2/1947 | Turnes | 132/88.7 |
| 2,735,435 | 2/1956 | Feinstein | 132/88.7 |

*Primary Examiner*—Steven A. Bratlie

*Attorney, Agent, or Firm*—Laney, Dougherty, Hessin & Beavers

[57] ABSTRACT

A lipstick applicator device which includes a pair of wedge-shaped compact halves interconnected at the relatively thinner side edges of the two halves to facilitate pivotation of the two halves from a cooperating closed position to an open position in which the halves are in back-to-back relation and are collectively wedge-shaped in configuration. Each of the wedge-shaped compact halves includes a compartment adjacent the narrow side of the wedge half which receives a lipstick insert block. Each respective lipstick insert block has an arcuate groove formed therein in which a contoured body of lipstick is positioned. The contoured bodies of lipstick cooperate, when the wedge-shaped compact halves are opened, to form a lipstick mold into which the lips of a user can be pressed to apply a relatively uniform coating of lipstick.

16 Claims, 6 Drawing Figures

LIPSTICK APPLICATOR DEVICE

BACKGROUND OF THE INVENTION

1. Field of the Invention

This invention relates to devices for applying cosmetics, and more particularly, to a lipstick applicator in the form of an easily used compact.

2. Brief Description of the Prior Art

The following statement is intended to be a prior art statement in compliance with the guidance and requirements of 37 C.F.R. §§ 1.56, 1.97 and 1.98. Among those prior art patents which disclose lipstick applicator devices having very general similarity to that proposed for use in the present invention are Turnes U.S. Pat. No. 2,416,029, Gorman U.S. Pat. No. 2,372,777 and Martin U.S. Pat. No. Des. 91,835. The Turnes patent relates to a cosmetic applicator device which is in the form of a closeable container which, when opened, presents a wedge-shaped body of lipstick to which the lips may be applied to transfer lipstick to the lips. In this case, the lipstick is completely exposed once the container is opened and can smear upon surrounding articles. Moreover, there is not support beneath the lipstick body which prevents it from chipping or flaking away when in use.

In Gorman U.S. Pat. No. 2,372,777, a flat plate carrying lipstick is pulled out of a compact-type structure, and then the lips are applied to opposite sides of this plate to cause lipstick to be applied to the lips.

The design patent to Martin discloses a flat, generally oval-shaped toilet accessory which may be opened by means of a tab to expose cosmetic material contained on the interior thereof.

Other types of lipstick applicators have been proposed, but have gained little commercial success over the years. In general, the type of applicator in prevalent usage is a cylindrical tubular device which contains a solid cylindrical body of lipstick material which projects from one end of the tube and is applied by grasping the tube in the fingers and pressing the body of lipstick against the lips. This conventional type of lipstick applicator presents several problems in use. First, use of the device is time-consuming, and the aesthetic and proper application of lipstick is a painstaking manipulation. Moreover, it requires continuous and careful scrutiny in a mirror when properly carried out. The described applicator device is also sometimes messy to store because the tube breaks or becomes ruptured, or the lid is lost from the tube after retraction of the body of lipstick, thus causing the lipstick to smear on all the articles in the vicinity, and to require a thorough cleaning of purses or similar devices in which the lipstick is stored or carried.

BRIEF DESCRIPTION OF THE PRESENT INVENTION

The present invention provides a compact, easily used lipstick applicator device which can be used to very expeditiously apply a relatively uniform and aesthetic coating of lipstick to the lips, and which, when not in use, retains the lipstick in an enclosed, position so that it does not soil or smear upon surrounding articles.

Broadly described, the lipstick applicator of the invention comprises a pair of wedge-shaped compact halves which are hinged to each other at the narrow or relatively thin side edges of the two halves. The lipstick applicator thus may be thought of as a compact which has a wedge-shaped configuration having a relatively thick side along one edge of the compact at which it opens, and a relatively thin or narrow side along the other edge of the compact where the two halves of the compact are hinged to each other.

Within each of the two wedge-shaped halves of the compact, a compartment is formed which is dimensioned and constructed to detachably receive a lipstick insert block. The lipstick insert block in each of the two wedge-shaped compact halves has an arcuate groove formed therein in which is located a body of lipstick which is shaped or configured in conformity with the natural lip contour of the user. When the two compact halves are opened apart from each other so that the outer sides are in back-to-back abutting relation, the two lipstick insert blocks are aligned in super-imposition, and the lipstick carried therein is positioned so that the lips of the user may be placed over and pressed against the two arcuately configured lipstick bodies to apply the lipstick in an aesthetic fashion to the lips of the user.

An important advantage of the present invention is to provide a lipstick applicator device which does not require any digital dexterity, nor indeed any manipulation other than the ability to grasp it between the fingers.

Another object of the invention is to provide a lipstick applicator device which allows lipstick to be applied to substantially all the lip surface of the user in an aesthetic fashion by the simple expedient of placing the lips against bodies of lipstick carried in the device, and pressing the lips toward each other in a biting action.

A further object of the invention is to provide a lipstick applicator device which retains the lipstick included in the device in a safe location to prevent soilage of surrounding articles, and smearing of the lipstick thereon.

Additional object and advantages of the invention will become apparent as the following detailed description of the invention is read in conjunction with the accompanying drawings which illustrate a preferred embodiment of the invention.

BRIEF DESCRIPTION OF THE DRAWINGS

FIG. 6 is a sectional view similar to FIG. 5, but taken through the other of the two halves of the compact.

DETAILED DESCRIPTION OF A PREFERRED EMBODIMENT OF THE INVENTION

Figure 1:
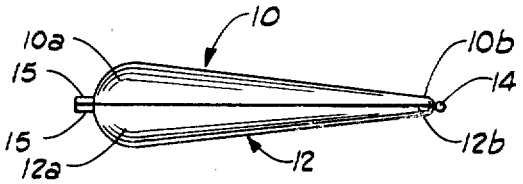
FIG. 1 is a side elevation view of the lipstick applicator device of the invention, and shows the applicator device in its closed, inoperative position.

Referring initially to FIG. 1 of the drawings, the lipstick applicator device of the invention is in the form of a compact or case which includes two parts or halves 10 and 12. Each of the compact parts 10 and 12 is wedge-shaped in side elevational configuration. Thus, the compact half 10 includes a relatively wide or thick front side 10*a* and a relatively thin or narrow rear edge 10*b*. Compact half 12 includes a similar thick front side 12*a* and a similar relatively thin or narrow rear edge 12*b*. The two wedge-shaped compact halves 10 and 12 are hingedly interconnected at their rear, relatively thin edges by means of a small hinge structure 14. At the forward side of each of the compact halves, each of the halves 10 and 12 includes a finger tab 15 by which the halves can be snapped closed by a suitable latching device (not shown), or opened apart by means of the fingers.

Figure 2:
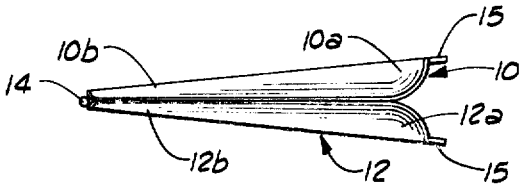
FIG. 2 is a side elevation view similar to FIG. 1, but illustrating the lipstick applicator device in its opened position ready for use in the application of lipstick.
Figure 3:
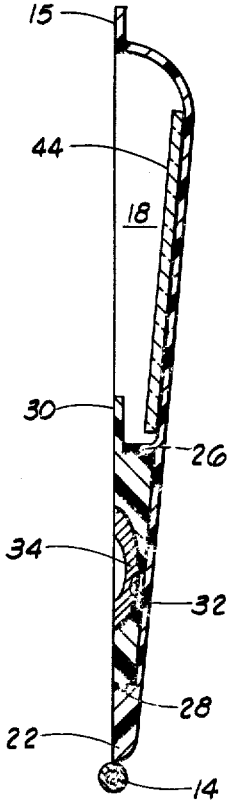
FIG. 3 is a plan view of the lipstick applicator device in its closed position.
Figure 3:
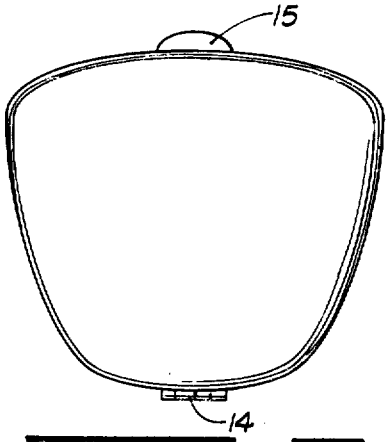

It will be noted that in plan view, each of the compact halves 10 and 12 is of generally trapezoidal configuration, when viewed in plan, and it will further be noted that when these halves are opened apart, their wedge-shaped configuration in the location of the hinge 14 is such that the halves abut flatly against each other and continue to together form a wedge-shaped overall configuration as shown in FIG. 2. Each of the compact halves 10 and 12 is dished to provide a hollow interior so that when the two halves are folded to the closed position as shown in FIG. 1, the compact has a hollow interior equivalent to the totality of the concavities formed in the two compact halves.

Each of the compact halves 10 and 12 is provided with an arcuate partition wall 16 which extends across the interior of the respective compact half between a pair of opposed side walls 18 and 20. Each compact half 10 and 12 also includes a relatively thick web portion 22 adjacent the hinge 14 at the respective thin rear side of 10*b* or 12*b*. The partition wall 16, side walls 18 and 20, and web portion 22 thus define a chamber which is dimensioned to detachably receive a lipstick insert block, designated generally by reference numeral 24. Each of the lipstick insert blocks 24 is preferably constructed of a block or solid body of synthetic resin material which fits snugly in the compartment or chamber formed between the side walls 18 and 20 and the web portion 22 and partition wall 16.

Figure 5:
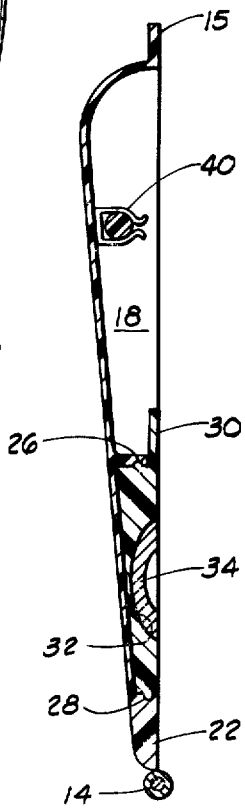
FIG. 5 is a sectional view taken along line 5—5 of FIG. 4 and through one of the halves of the compact forming part of the applicator device.

Each lipstick insert block 24 further includes a pair of snap-engaging tabs or lugs 26 and 28 formed at opposite sides thereof and dimensioned to matingly engage a pair of lug-receiving recesses formed in the partition wall 16 and the web 22, respectively. The lipstick insert block 24 also includes a snap-out tab 30 which projects through a small relief formed in the center of the partition wall 16. The snap-out tab 30 thus is spaced from the flat outer side of the compact half as shown in FIG. 5, and can be used to extricate the lipstick insert block from the chamber in which it is seated.

Figure 4:
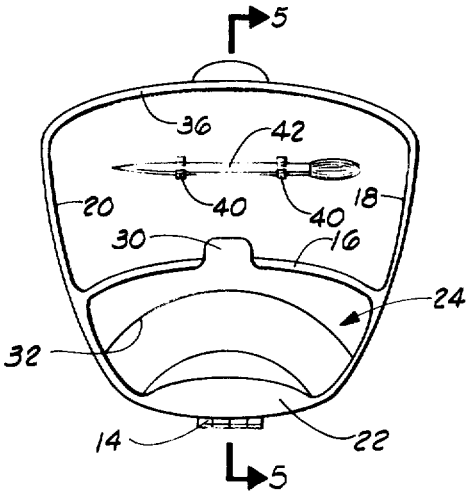
FIG. 4 is a plan view of the inner side of one of the compact halves of the lipstick applicator device of the invention.

Each of the lipstick insert blocks 24 further defines an arcuately cross-sectioned trough or groove 32. The lipstick groove 32 is arcuately shaped, over its length, as shown in FIG. 4 and receives therein, a body of lipstick 34. Each of the bodies of lipstick 34 are contoured or shaped so as to be complementary in configuration to the lips of the user of the lipstick-applying device. This will be apparent by reference to FIGS. 4 and 5 of the drawings.

It will also be noted in referring to FIG. 2 that, given the same relative location of the lipstick insert blocks 24 and the bodies of lipstick 34 carried therein in each of the two compact halves, when these halves are folded back to the position shown in FIG. 2, the two lipstick bodies 34 carried in each of the compact halves are superimposed directly over each other. The user need then only place the relatively small wedge-shaped ends of the two halves inside the mouth, with the upper lip and lower lip engaging the two bodies of lipstick 34 carried in the two compact halves. By then pressing the lips into the two bodies of lipstick, which are already contoured to conform essentially to the natural contour of the lips, a smooth and even application of lipstick to the lips is achieved.

To facilitate the touching up of the applied lipstick, and if desired, viewing the lipstick to reassure that it is evenly applied, the chamber which is defined between partition wall 16 and end wall 36 disposed at the large side or end of the compact half 12 carries a mirror 44. In the corresponding space in the other of the compact halves 10, a pair of laterally spaced spring clips 40 are used to permit a small touch-up brush 42 to be carried in this compartment.

From the foregoing description, it will be apparent that an especially usefuly lipstick applicator device is provided which is compact in configuration and size, relatively lightweight and is susceptible to ease of use by the user. Moreover, the device can be employed to relatively easily apply lipstick to the lips of the user over substantially all of the lip surface with only minor touch-up required. Further, the device prevents lipstick from being smeared on surrounding articles once the compact is closed.

Although a preferred embodiment of the invention has been herein described in order to provide a description illustrative of the employment of the basic principles which underlie the invention, it will be understood that various changes and innovations can be made in the illustrated embodiment without departure from these basic principles. Changes and innovations of this type are therefore deemed to be circumscribed by the spirit and scope of the invention, except as the same may be necessarily limited by the appended claims, or reasonable equivalents thereof.

What is claimed is:

1. A lipstick applicator device comprising:
   - a first compact half including a substantially planar back having a wide side and a narrow side;
   - a second compact half including a substantially planar back having a wide side and a narrow side;
   - an edge formed about the border of each compact half, each of said edges extending generally uprightly from its associated back and including a thick edge along said wide side and a thin edge along said narrow side;
   - partition means extending generally uprightly from each of said backs, said partition means and said thin edges forming a recess therebetween;
   - hinge means joining said compact halves to each other at the thin edges thereof;
   - means for maintaining a body of lipstick in each of said recesses; and
   - an arcuate body of lipstick received in each of said recesses such that when said compact halves are pivoted to an opened position in back-to-back relation, said arcuate bodies of lipsticks overlie each other at a location adjacent the thin edges of the compact halves, and in positions conforming to the natural position of the lips.

2. A lipstick applicator as defined in claim 1 and further characterized as including a pair of insert blocks each detachably insertable into the interior of one of said compact halves, and each having an arcuate, concave groove there accommodating said lipstick body.

3. A lipstick applicator as defined in claim 2 wherein each of said blocks includes lugs for snap-engaging the respective block with the respective compact half to facilitate rapid replacement of the block and the lipstick body carried therein.

4. A lipstick applicator as defined in claim 1 wherein the back of each compact half defines an interior space on one side thereof in which the respective lipstick body is located.

5. A lipstick applicator as defined in claim 4, and further characterized as including:

retainer means secured to the back of one of said compact halves and projecting into the interior space defined thereby; and a lipstick touch-up brush removably attached to said one compact half by said retainer means.

6. A lipstick applicator as defined in claim 4 and further characterized as including a pair of insert blocks each detachably insertable into the interior space of one of said compact halves, and each having an arcuate, concave groove therein accommodating one of said lipstick bodies.

7. A lipstick applicator as defined in claim 1 and further characterized as including a mirror attached to the back of one of said compact halves between said lipstick body and said thick edge in one of said compact halves.

8. A lipstick applicator as defined in claim 7 and further characterized as including:

retainer means secured to the back of the other of said compact halves and projecting into the interior space defined thereby; and a lipstick touch-up brush removably attached to said other compact half by said retainer means.

9. A lipstick applicator device comprising:

a first wedge-shaped compact half having a substantially planar back, a thick edge, and a thin edge;

a second wedge-shaped compact half having a substantially planar back, a thick edge, and a thin edge;

hinge means joining said compact halves to each other at the thin edges thereof, said hinge means permitting pivoting of said halves between a first position wherein said edges on said first compact half contact said edges on said second compact half and a second position wherein said backs are in substantially planar contact with one another;

a recess formed in said first compact half adjacent said thin edge;

a recess formed in said second compact half adjacent said thin edge;

means for maintaining a body of lipstick in each of said recesses; and an arcuate body of lipstick received in each of said recesses such that when said compact halves are pivoted to their second position, said arcuate bodies of lipsticks overlie each other at a location adjacent the thin edges of the compact halves, and in positions conforming to the natural positions of the lips, and when said compact halves are pivoted to their first position, said lipstick bodies are received within a cavity formed by said compact halves.

10. A lipstick applicator as defined in claim 9 and further characterized as including a pair of insert blocks each detachably insertable into the interior of one of said compact halves, and each having an arcuate, concave groove there accomodating said lipstick body.

11. A lipstick applicator as defined in claim 10 wherein each of said blocks includes lugs for snap-engaging the respective block with the respective compact half to facilitate rapid replacement of the block and the lipstick body carried therein.

12. A lipstick applicator as defined in claim 9 wherein the back of each compact half defines an interior space on one side thereof in which the respective lipstick body is located.

13. A lipstick applicator as defined in claim 12 and further characterized as including:

retainer means secured to the back of one of said compact halves and projecting into the interior space defined thereby; and a lipstick touch-up brush removably attached to said one compact half by said retainer means.

14. A lipstick applicator as defined in claim 12 and further characterized as including a pair of insert blocks each detachably insertable into the interior space of one of said compact halves, and each having an arcuate, concave groove therein accomodating one of said lipstick bodies.

15. A lipstick applicator as defined in claim 1 and further characterized as including a mirror attached to the back of one of said compact halves and positioned between said lipstick body and said thick edge in one of said compact halves.

16. A lipstick applicator as defined in claim 15, and further characterized as including:

retainer means secured to the back of the other of said compact halves and projecting into the interior space defined thereby; and a lipstick touch-up brush removably attached to said other compact half by said retainer means.

* * * * *